US008348014B2

(12) United States Patent
Kerstetter, Jr.

(10) Patent No.: US 8,348,014 B2
(45) Date of Patent: Jan. 8, 2013

(54) FALL-ARREST LADDER SYSTEM

(75) Inventor: George O. Kerstetter, Jr., Auburn, NY (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 404 days.

(21) Appl. No.: 12/492,325

(22) Filed: Jun. 26, 2009

(65) Prior Publication Data

US 2010/0326768 A1 Dec. 30, 2010

(51) Int. Cl.
*A62B 1/16* (2006.01)

(52) U.S. Cl. ..... 182/8; 182/5

(58) Field of Classification Search ..... 182/5, 8, 182/206

See application file for complete search history.

(56) References Cited

U.S. PATENT DOCUMENTS

| | | | | | |
|---|---|---|---|---|---|
| 1,352,055 | A | * | 9/1920 | Di Salvatore | 182/15 |
| 2,277,392 | A | * | 3/1942 | Dahlberg | 182/211 |
| 3,177,543 | A | * | 4/1965 | Fountain | 188/65.2 |
| 3,598,200 | A | * | 8/1971 | Thompson | 182/8 |
| 3,908,791 | A | * | 9/1975 | Kleine et al. | 182/8 |
| 3,979,797 | A | * | 9/1976 | Stember | 24/134 R |
| 4,059,871 | A | * | 11/1977 | Swager | 24/134 R |
| 4,071,926 | A | * | 2/1978 | Sweet et al. | 24/136 R |
| 4,846,075 | A | * | 7/1989 | Tupper | 104/209 |
| 4,878,270 | A | * | 11/1989 | Westerkamp | 24/132 R |
| 5,238,084 | A | * | 8/1993 | Swager | 182/8 |
| 5,265,696 | A | * | 11/1993 | Casebolt | 182/8 |
| 5,857,544 | A | * | 1/1999 | Del Sole | 182/180.3 |
| 5,875,867 | A | * | 3/1999 | Beard | 182/45 |
| 6,837,337 | B2 | * | 1/2005 | Thomas et al. | 182/8 |
| 7,219,766 | B2 | * | 5/2007 | Deuer | 182/206 |
| 7,752,719 | B2 | * | 7/2010 | Howard | 24/134 L |
| 2002/0014370 | A1 | * | 2/2002 | Casebolt et al. | 182/5 |
| 2004/0129494 | A1 | * | 7/2004 | Cherpitel | 182/5 |
| 2007/0158137 | A1 | * | 7/2007 | Petersen | 182/8 |
| 2007/0193824 | A1 | * | 8/2007 | Anderson | 182/8 |
| 2009/0249712 | A1 | * | 10/2009 | Brickell et al. | 52/173.1 |
| 2010/0044151 | A1 | * | 2/2010 | Vollenweider et al. | 182/8 |

* cited by examiner

*Primary Examiner* — Katherine W Michell
*Assistant Examiner* — Johnnie A Shablack

(57) ABSTRACT

A safety-featured ladder, including taut rope wrapped over top of the top rung and under bottom of the bottom rung and fixedly connected to the ladder when downward force is applied to the rope in front of the ladder. In a first embodiment, a sleeve including a pulley subsystem is attached to a body harness worn by a climber and can move or slide along the rope only when climbing up ladder. In a second embodiment, a sleeve including a different pulley subsystem including a centrifugal brake is attached to a body harness worn by a climber and can move or slide along the rope when climbing up or climbing down. However, if the climber loses footing and starts to fall the sleeve grabs the rope, and/or the rope grabs the sleeve, which prevents the climber from falling more than a few inches and from injury. Hooks at top of the ladder can hook around transverse cables atop poles.

12 Claims, 10 Drawing Sheets

FALL-ARREST LADDER SYSTEM

BACKGROUND INFORMATION

A ladder is a familiar piece of equipment normally utilized by persons for reaching areas above ground or above floor level that are otherwise out of reach. Anyone who has climbed to the top of a long ladder, for example, twenty-five feet up a long extension ladder, knows that that effort is accompanied by danger of falling and getting seriously hurt or even killed. Particularly, in outdoor venues, bad weather or snow/ice may make this dangerous activity even more dangerous.

There are telecommunications company service personnel who have to climb ladders in order to perform their jobs out-of-doors, oftentimes responding during bad weather conditions which may have caused downed power or telecommunications lines, etc. Sometimes, such personnel even find it necessary to support the upper end of a ladder on a transverse, elevated telecommunications cable itself. This can compound the hazard even further, because a transverse or horizontal cable strung some twenty-five feet above ground between vertical poles offers a less stable support for an extension ladder than support provided by a vertical pole or a side of a building. There is, therefore, need for a ladder, such as an extension ladder, to incorporate a safety system which can reduce or prevent injury to someone falling from a ladder, regardless of why and how the ladder is being used.

DETAILED DESCRIPTION OF PREFERRED EMBODIMENTS

Figure 1:
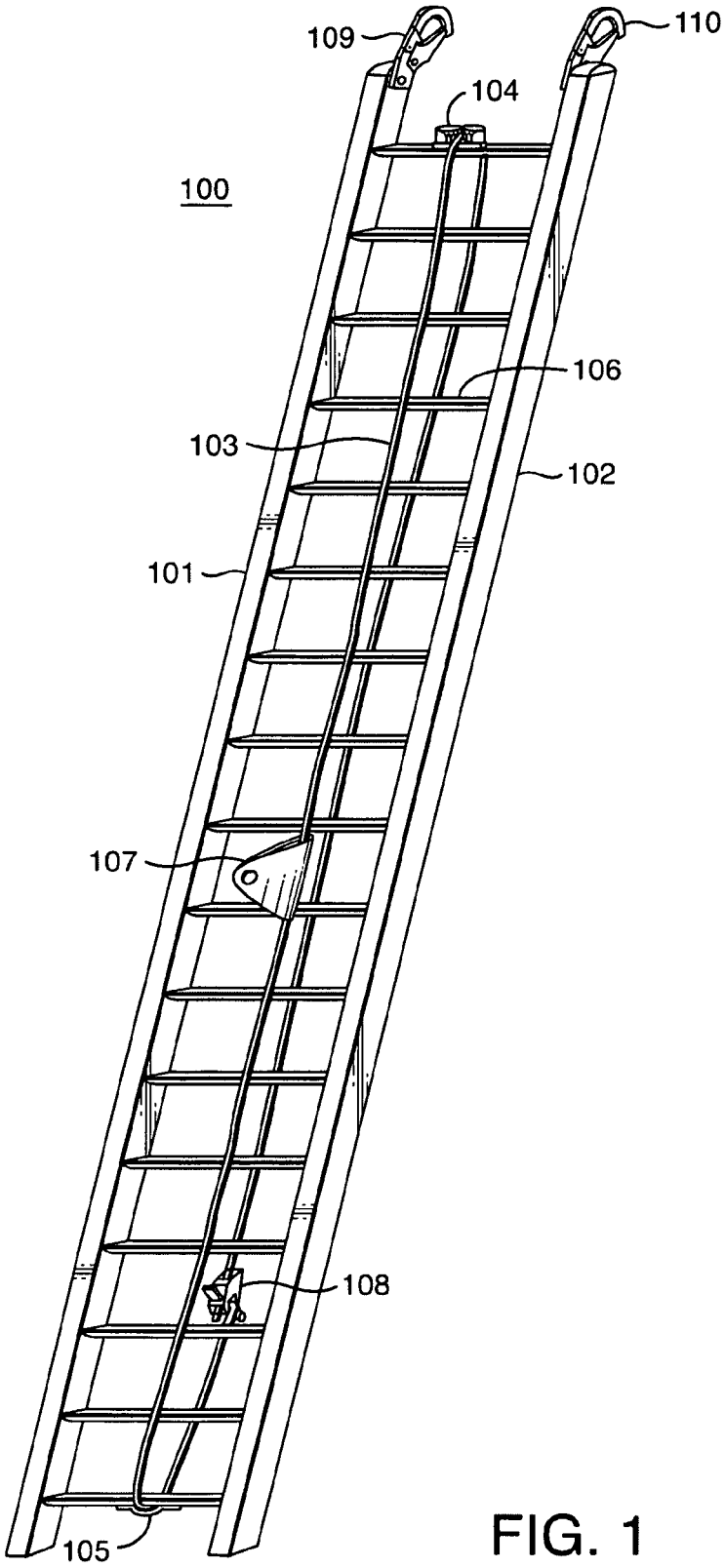
FIG. 1 is an exemplary view of a fixed-length ladder that can be used with the Fall-Arrest Ladder System including safety features.

In this description, the same reference numeral in different Figs. refers to the same item. Otherwise, reference numerals of each Fig. start with the same number as the number of that Fig. For example, FIG. 3 has numerals in the "300" category and FIG. 4 has numerals in the "400" category, etc.

In overview, the Fall-Arrest Ladder System (FALS) is applicable to virtually any kind of fixed-length ladder or extension ladder, long and short. An extension ladder can be extended to a desired height by an operator/climber. Then, a dedicated safety rope which had been previously threaded through a moveable or slidable sleeve mechanism, the rope having also been previously strung around the ladder, over top of the top rung and under bottom of the bottom rung, is made taut by the user/operator. That safety rope in operative connection with the movable sleeve is a safety subsystem of FALS, contributing to safe usage of the ladder by the user/operator. The mechanism for holding the rope taut is located at the back of the ladder and the mechanism for preventing the rope from sliding relative to the ladder can be located on the top rung of the ladder and, therefore, they are not in the pathway of the person climbing the ladder. The rope is held generally parallel to the side rails of the ladder. The climber wears a body harness and, before ascending, attaches the harness to the movable sleeve.

The climber ascends the ladder to the desired height as the moveable sleeve follows-along, being constrained to the vertical pathway determined by the safety rope over which it traverses. In one embodiment, the sleeve is pre-set by the operator to move only upwards along the rope. If the climber loses footing and starts to fall from the ladder, the harness in cooperation with the sleeve, rope and ladder hold the climber essentially in place and allow him/her to regain footing on the ladder. The sleeve cannot move in the reverse direction down the rope unless and until the climber first affirmatively adjusts the sleeve to disengage the rope. The climber would make such disengagement prior to controllably climbing down the ladder.

In another embodiment, the sleeve mechanism need not be pre-set by the operator before climbing upward nor adjusted to disengage the rope before climbing downward. In this other embodiment the sleeve can move upwards or downwards along the rope in response to the operator climbing up or climbing down the ladder. But, if the climber loses footing and starts to fall, the fall is arrested immediately by a centrifugal brake.

A further feature can be employed with either of these embodiments. The ladder rails also include spring-clip hooks to engage a cable horizontally suspended between two vertical poles, thereby additionally stabilizing the ladder and ensuring that a climber who lost footing can regain footing on a ladder supported by only a horizontally-oriented cable.

FIG. 1 is an exemplary view of a ladder 100 that can be used with a fall arrest ladder system, the ladder including safety features. Ladder 100 is shown as a fixed length ladder but, instead, it could have been shown as an extension ladder; either version shall work with exemplary embodiments with equal success. Either version can be, typically, a ladder made by the Werner company. It has parallel side rails 101 and 102 (but could have non-parallel side rails with the bottom wider than the top) with multiple rungs 106. Rope 103 is shown loosely strung over the top of the top rung and under the bottom of the bottom rung. Rope 103 gets tightened-up prior to climbing the ladder, to be discussed below. Rope 103 is held approximately in the center of the rungs and approximately parallel to side rails 101/102 by rope-cleat 104 and rope guide 105 affixed to the top of the top rung and bottom of the bottom rung, respectively.

Figure 2A:
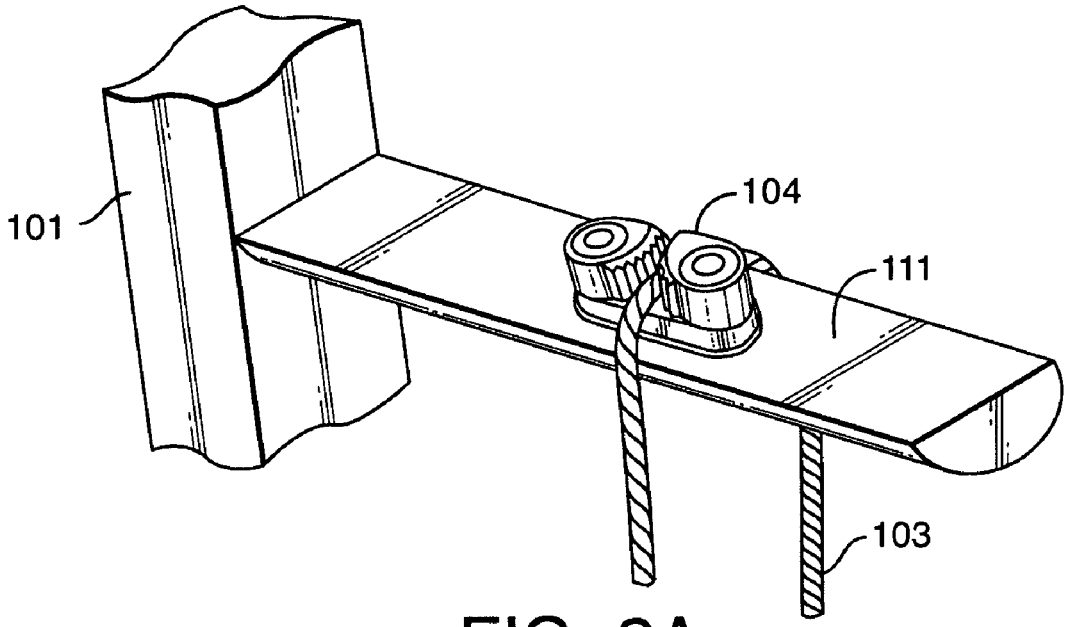
FIGS. 2A and 2B are an exemplary broken view of the ladder of FIG. 1 showing upper and lower portions thereof.
Figure 2B:
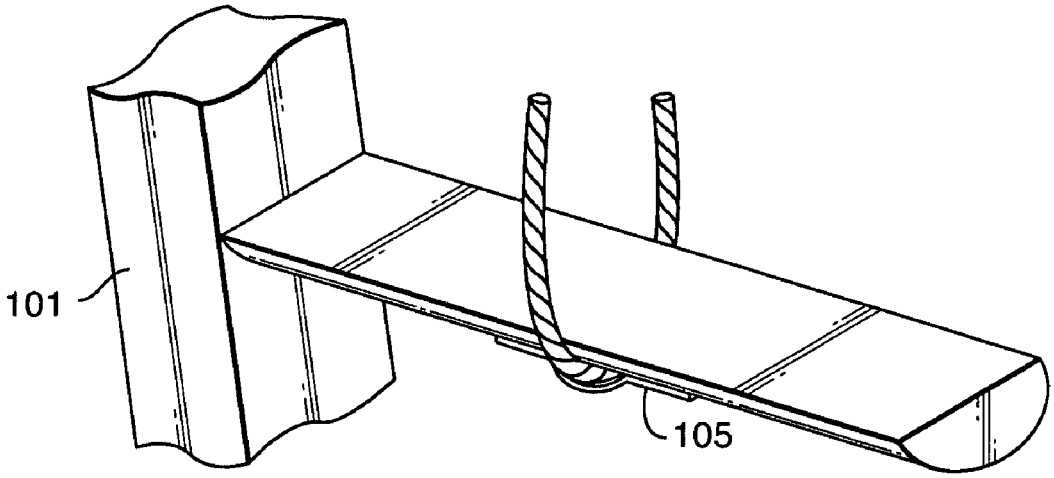

FIGS. 2A and 2B show rope cleat 104 and rope guide 105 in a larger view centrally-affixed to the top of the top rung and bottom of the bottom rung, respectively, of the ladder of FIG. 1. Alternatively, rope cleat 104 can be affixed to the bottom of the bottom rung and rope guide 105 can be affixed to the top of the top rung, or two rope cleats could be used instead of one. Although a centralized location of the rope may offer more stability than a non-centralized location when holding a climber, in another embodiment, the rope cleat and guide need not be centrally-affixed relative to side rails 101/102, and the rope can be offset closer to a side rail if preferred.

Figure 3A:
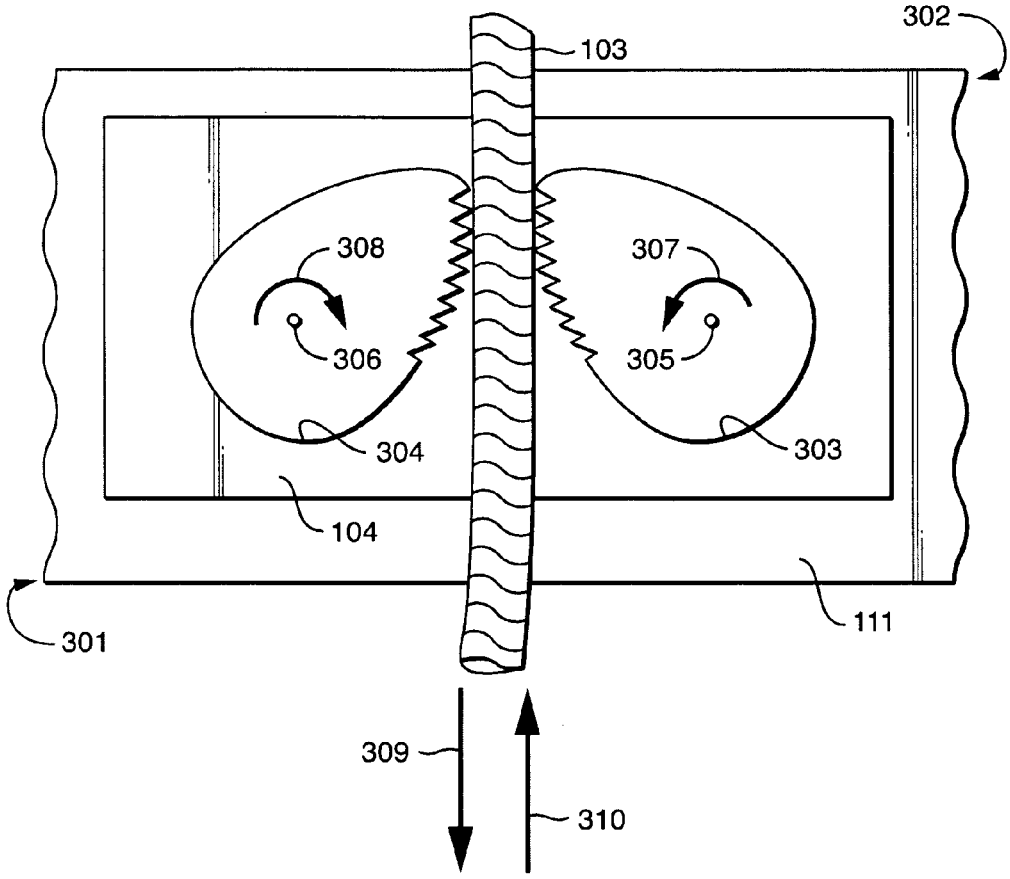
FIGS. 3A and 3B are exemplary embodiments of a rope cam-cleat (hereinafter "rope-cleat") and a rope-guide used in FIGS. 2A and 2B, respectively.

FIG. 3A shows a further enlarged top view of rope (cam) cleat 104, which is a commercially-available product. Cam-cleats can be used where ropes must be held taut, and are commonly used, for example, in sailboat rigging to hold a rope taut. Harken is the name of one company that supplies these products. In FIG. 3A, rope cleat 104 is shown on top of the top of ladder-rung 111. Front edge 301 of rung 111 is on the side of the ladder used for climbing, and rear edge 302 of rung 111 is also shown.

Figure 3B:
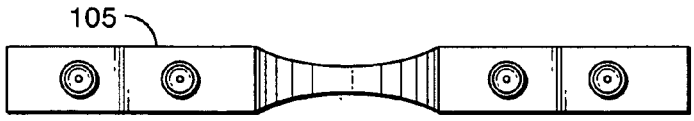

Camber shaped mechanism 303 rotates about axel 305 and is coil-spring biased in counterclockwise direction 307. Camber shaped mechanism 304 rotates about axel 306 and is coil-spring biased in clockwise direction 308. (Coil springs are not shown). Therefore, rope 103 can be pulled in direction 310 and the teeth of both mechanisms do not prevent the rope from sliding between the mechanisms while moving in that direction. This is the direction in which the rope is pulled when it is being snugged-up using the rope brake discussed below and in connection with FIG. 6. But, the teeth of both mechanisms, which bite into the rope, in combination with the directions of the spring-biased forces on the mechanisms prevent the rope from moving in opposite direction 309, which heads down the front of the ladder. Therefore, a climber shall be safely suspended by the rope if the climber falls from the ladder, without the rope slipping relative to the ladder. FIG. 3B is a simple pass-through rope guide which can be fashioned from steel, aluminum or other strong material suitable for guiding a rope and withstanding the stresses of force and environment discussed herein.

Returning to FIG. 1, rope 103 is threaded through sleeve 107 at the front or climbing-sided of the ladder, and is threaded through and clamped by rope-brake 108 at the back or non-climbing side of the ladder. Rope brake 108 is used to tighten loosely strung rope 103 and thereafter, in combination with rope cleat 104, to hold rope 103 taut and immobile relative to the ladder. Detail operation of rope brake 108 is presented below in connection with FIG. 6. In addition, snap hooks 109 and 110 are located at the tops of side rails 101/102 respectively, the detail of which is also presented below. Ladder 100 can be a fixed-length climbing apparatus or can be an extension ladder of common design. The rope and pulley detail associated with the extension mechanism required for an extension ladder is not disclosed because exemplary embodiments can operate with extension ladders while not being impacted by them and not interfering with operation of them.

Figure 4:
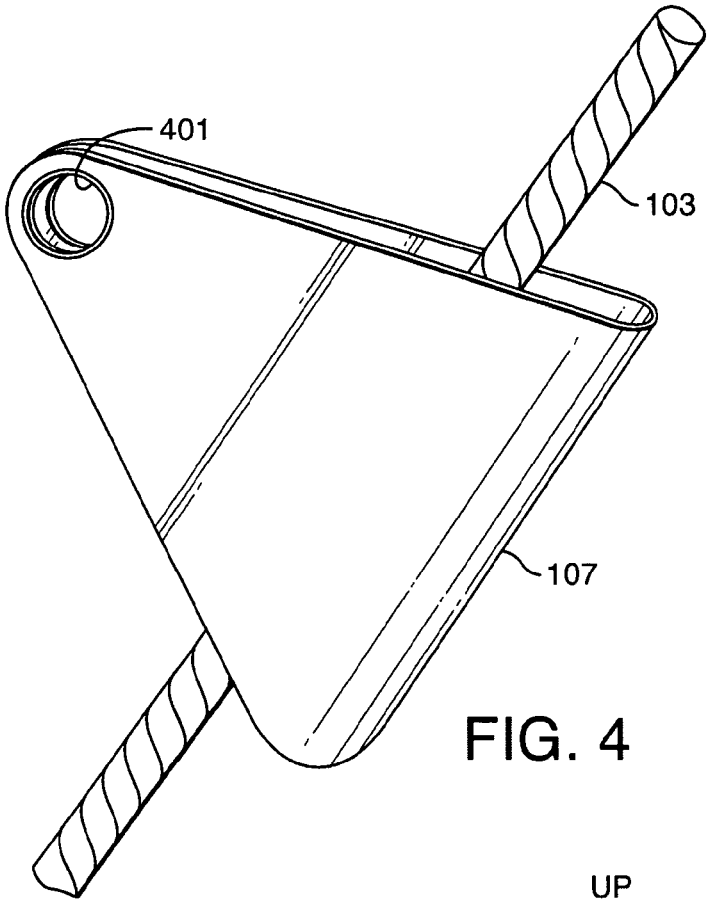
FIG. 4 shows an exemplary embodiment of a sleeve for use with a rope.

FIG. 4 shows an exemplary embodiment of a sleeve or sleeve mechanism for use with a rope. Sleeve 107 has an outer shell or housing which wraps around or encompasses rope 103 or, in other words, rope 103 is inserted or threaded through sleeve 107 as shown. Sleeve 107 is also made from steel and/or aluminum or other strong material capable of withstanding stresses imposed on it by physical forces and environmental conditions disclosed herein. Sleeve 107 is moveable and/or slideable along rope 103, as discussed below. Ring hole 401 is configured through the sleeve 107 to allow a metal ring such as a carabiner ring (ring not shown in this Fig.) to attach a body harness (harness not shown in this Fig.) to the sleeve.

Figure 5:
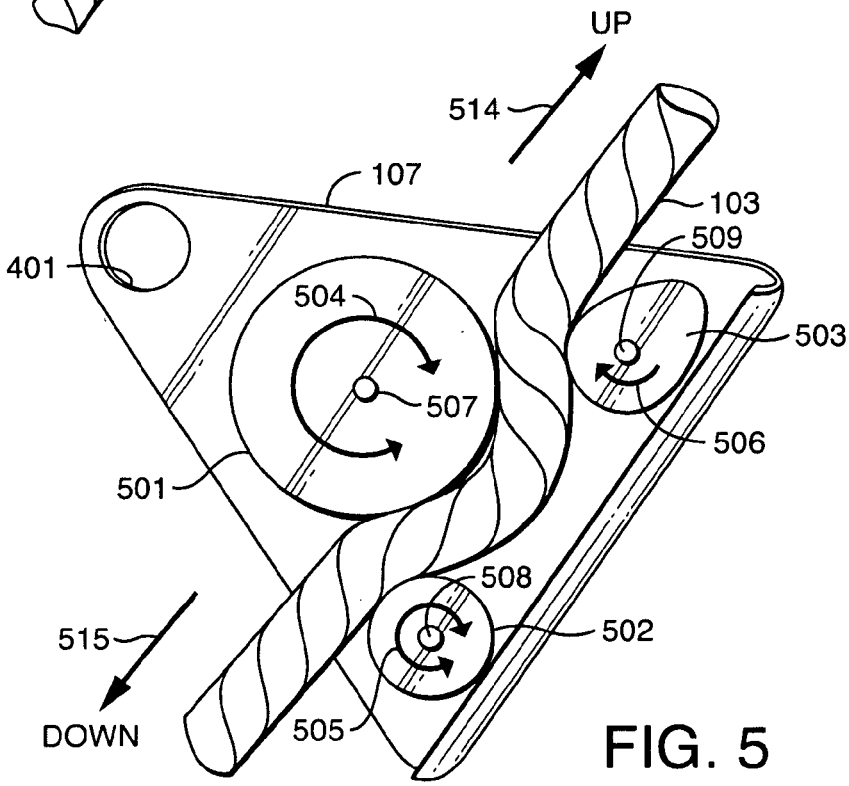
FIG. 5 shows an exemplary embodiment of the internal-mechanisms of the sleeve of FIG. 4.

FIG. 5 is an exemplary embodiment of the sleeve of FIG. 4 with a portion of the outer surface, or chassis, of the sleeve removed to show internal-mechanisms of the sleeve of FIG. 4. Pulley 501 is circular in shape and rotatably mounted on axel 507 which is attached to sleeve 107 at a fixed location, pulley 501 being capable of rotating in either clockwise or counter-clockwise directions 504, depending on whether a climber is, respectively, ascending or descending the ladder. Pulley 502 is also circular in shape and rotatably mounted on axel 508 which is attached to sleeve 107 at another fixed location, pulley 502 also being capable of rotating in both clockwise and counterclockwise directions 505. The rims of pulleys 501 and 502 are spaced apart an appropriate distance to grasp and guide rope 103. These two pulleys are configured to ride along rope 103 responsive to being pulled towards the top of ladder 100 when the climber ascends the ladder, and configured to ride along rope 103 responsive to being pulled towards the bottom of ladder 100 when the climber controllably descends the ladder. The side walls of the pulleys at the peripheries of the pulleys can be concaved (not shown in this Fig.; see FIG. 10) to better accommodate the round cross-sectional surface of a rope.

Pulley 503 is camber-shaped, where a portion of the periphery of pulley 503 is approximately circular and the remaining portion of the periphery arches outwardly beyond an imaginary circumference consistent with the circular portion of the pulley, thereby forming a bump or protrusion. The side wall of pulley 503 at its approximately circular periphery can also be concaved (not shown in this Fig.) to better accommodate the round cross-sectional surface of a rope and configured with teeth oriented in a direction that allows the rope to slide across the side wall when the climber is ascending and causes the rope to grab the side wall (or vice-versa) when the climber is descending.

Pulley 503 is rotatably mounted on axel 509 which is held within sleeve 107 at one of two defined locations (both locations not shown in this Fig.). In the embodiment shown, pulley 503 is constrained from making a complete revolution in the counter-clockwise direction, as the ladder is climbed, by hitting a physical stop (not shown). Pulley 503 can also rotate in the clockwise direction 506, thereby allowing its protrusion to cause a pinch-point against rope 103 when sleeve 107 moves down, in direction 515 away from the top of ladder 100 which is located in the direction 514. Teeth or grooves can also be configured in the side wall near the protrusion to better-grab the rope when the pinch point is caused.

Figure 5A:
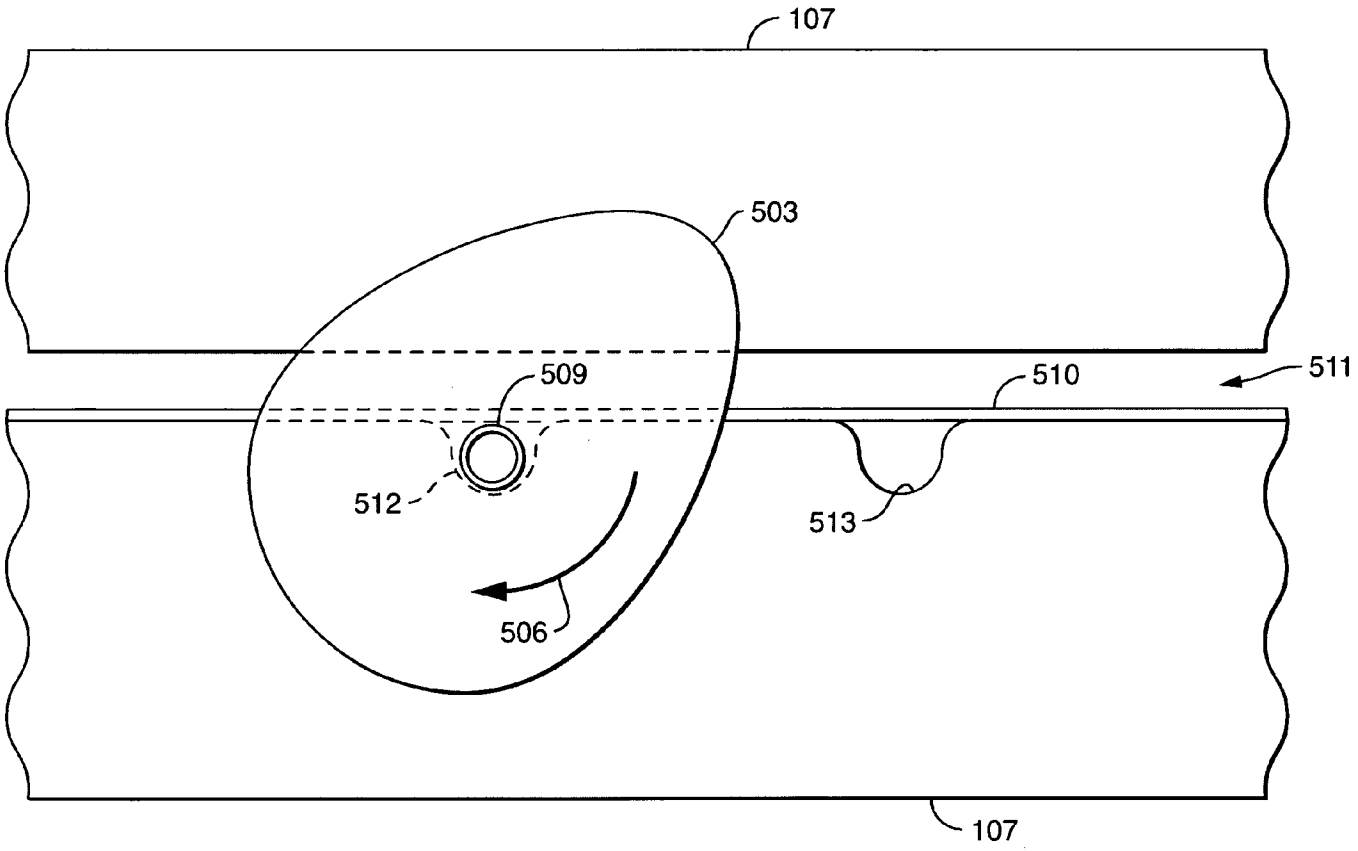
FIG. 5A shows additional detail relative to control of a camber-shaped pulley included within the exemplary embodiment of FIG. 5.

FIG. 5A shows additional detail relative to control of camber-shaped pulley 503. A portion of the chassis of 107 is shown, along with camber shaped pulley 503 mounted on axel 509. Axel 509 is shown contained within operative-position axel-hole 512 and is held in place by force generated by metal restraint 510 made from spring steel or aluminum or similar material. Restraint 510 is resilient, thereby permitting axel 509 to be manually moved to non-operative position axel-hole 513 located a short distance away from axel hole 512, perhaps one to two inches which is sufficient distance to prevent any portion of pulley 503 from touching rope 103. Gap 511 is sufficiently wide to accommodate the diameter of axel 509 and the thickness of restraint 510, enabling manual sliding of axel 509 in gap 511 and manual re-positioning of axel 509 into axel hole 513. When located in axel-hole 513, rope 103 does not touch or engage cam or pulley 503, permitting downward motion of sleeve 107 in direction 515, away from the top of ladder 100, without causing a clockwise rotation of camber pulley 503 and thereby avoiding a pinch-point against rope 103. This allows a person who has climbed up the ladder to also climb down. In this embodiment, while climbing downward, fall protection for the climber has been suspended and the climber needs to use caution while descending; in another embodiment, described below in connection with FIGS. 9 and 10, fall protection is maintained for the climber while ascending or descending.

Figure 6:
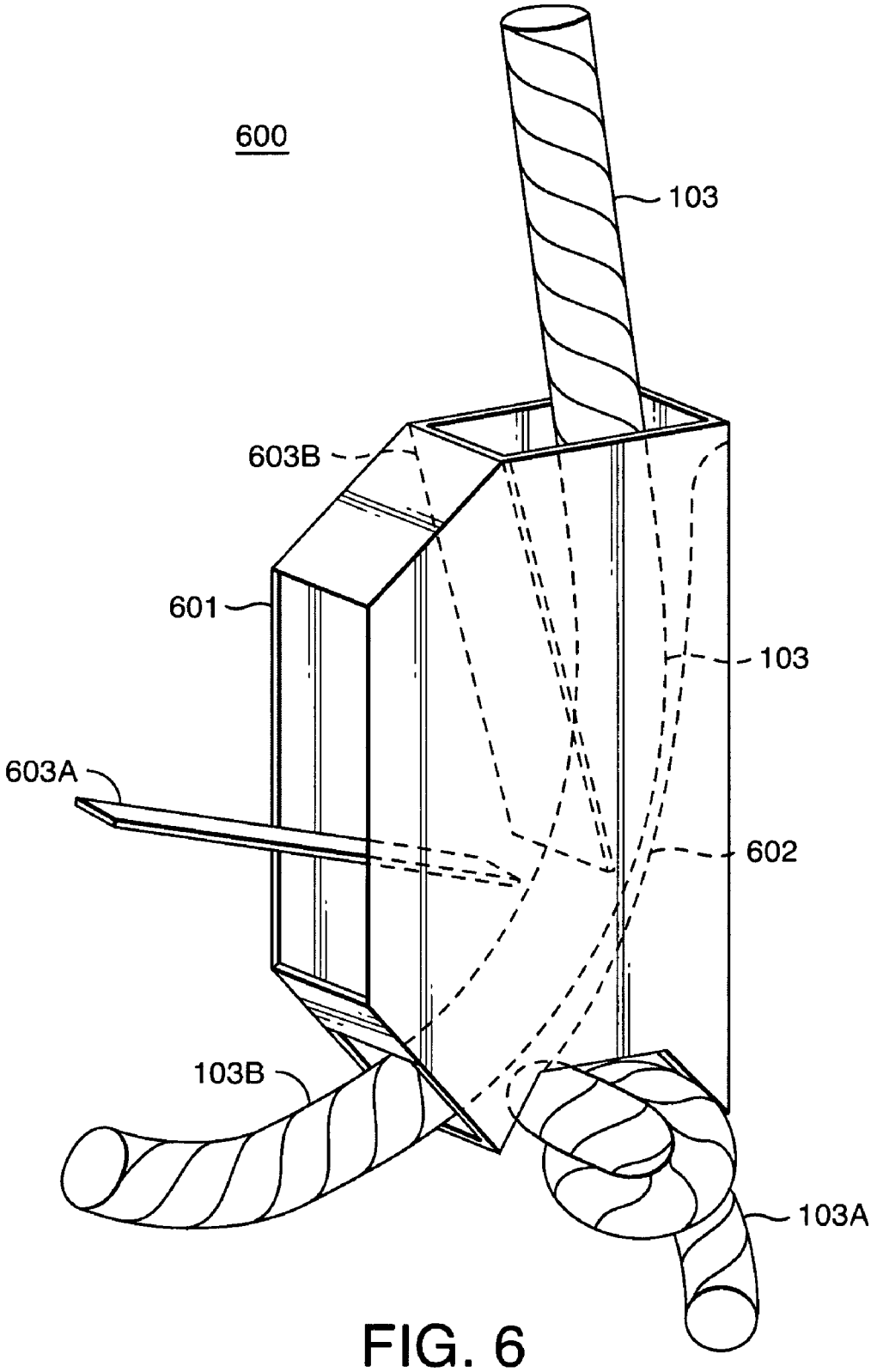
FIG. 6 shows an exemplary embodiment of a rope-brake.

FIG. 6 shows an exemplary embodiment of rope-brake 600. Rope end 103A is one end of rope 103 and is tied to the bottom of the exterior of chassis 601. Rope end 103B is the other end of rope 103 and was threaded through rope-brake 600 as shown in hidden dash lines, after it had first been threaded through rope cleat 104 and rope guide 105 on the top and bottom rungs, respectively, of the ladder. Rope 103 rests against rope constraint 602, one edge of constraint 602 being shown as a hidden dash line, and is clamped against rope constraint 602 by manual operation of a clamping mechanism having positions 603A and 603B. In position shown as 603A, clamping mechanism 603 does not exert force or pressure against rope 103 allowing it to move freely through rope-brake 600, whereby the operator can draw the rope tight or taut around the top/bottom ladder rungs, or can remove the rope entirely if not wanted in a particular circumstance. But, in the position shown as 603B, clamping mechanism 603 does exert force or pressure against rope 103 holding it firmly in place. In this manner, an operator can snug-up rope 103 which is shown, in FIG. 1, as being loosely strung around the top and bottom rungs of ladder 100, and thereafter hold the rope in a taut condition by operation of clamping mechanism 603. This is performed after the ladder is extended, if an extension ladder, and prior to a climber attempting to climb the ladder. Rope-brake 600 is out-of-the-way, located on the side of the ladder associated with top rung rear edge 302 shown in FIG. 3A which is opposite from the climbing side of the ladder. Rope-brakes may also be commercially available.

Figure 7:
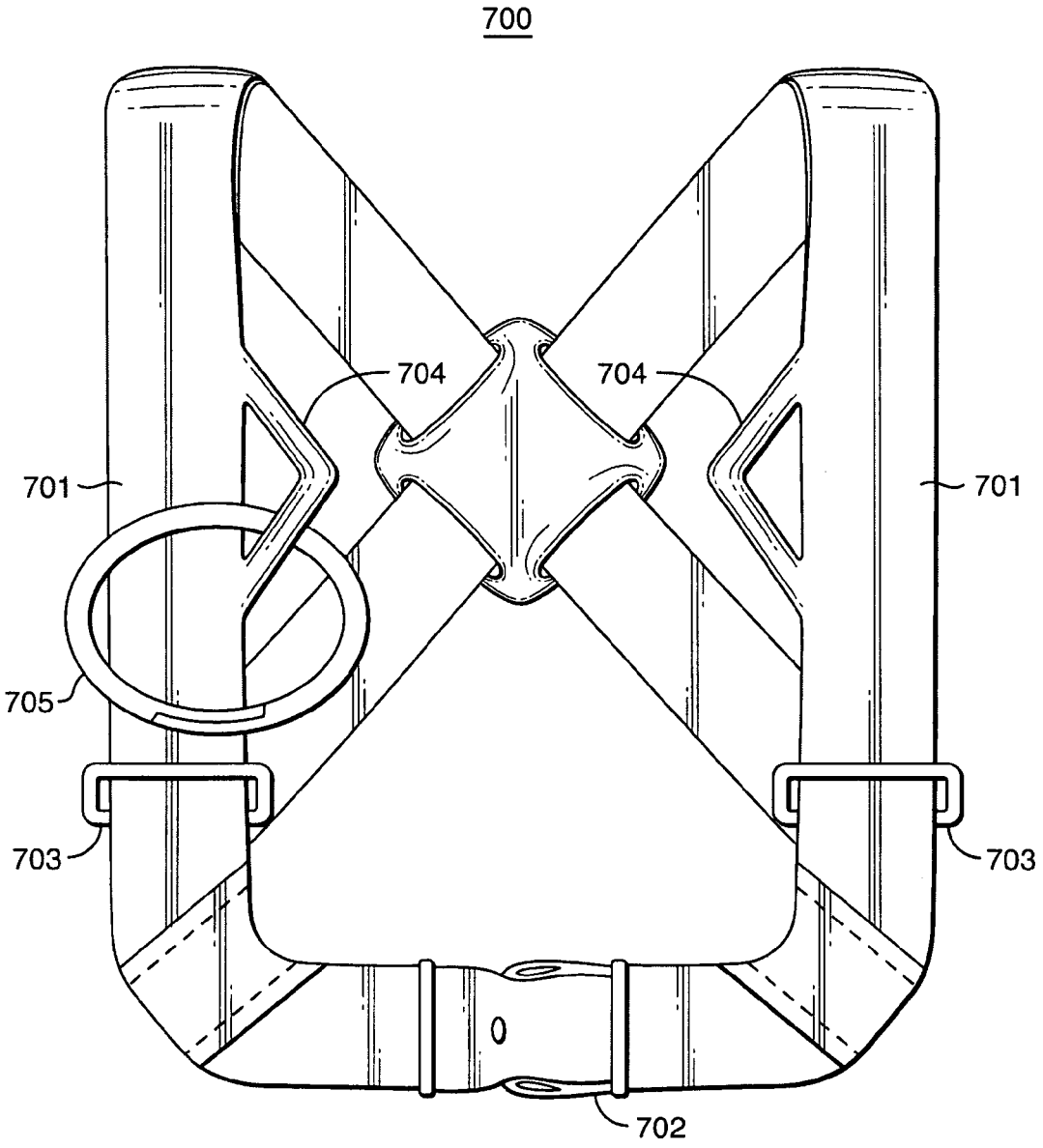
FIG. 7 depicts an exemplary body harness.

FIG. 7 depicts an exemplary climbing harness. A climber straps harness 700 around his/her chest, by opening buckle 702, inserting arms under straps 701 and thereafter buckling-up. The harness is adjustable to provide a proper body-fit by adjusting length of straps 701 controlled by adjustment rings 703 located on straps 701. Tabs 704, made from nylon, as is the rest of harness 700 aside from metal buckles and rings, can be pulled close together. When pulled together, both tabs 704 can be held or connected together by a metal ring 705, like a carabiner ring, and that metal ring can be further attached through hole 401 to sleeve 107. Therefore, when a user or climber is ascending the ladder, the harness pulls the sleeve up the now-taut rope because pulleys 501 and 502 permit that motion to occur and pulley 503 does not interfere on the way up. But, assuming that camber-shaped pulley 503 was set to its operative position in axel hole 512 prior to starting the climb, if the climber starts to fall, pulley 503 causes a pinch point to occur against rope 103 within less than one complete revolution of pulley 503. Thus, the climber does not descend appreciably, the so-called "fall" being limited to mere inches of downward vertical displacement, whereupon there is virtually no strain placed on the body of the climber resulting from loss of footing on the ladder.

Figure 8A:
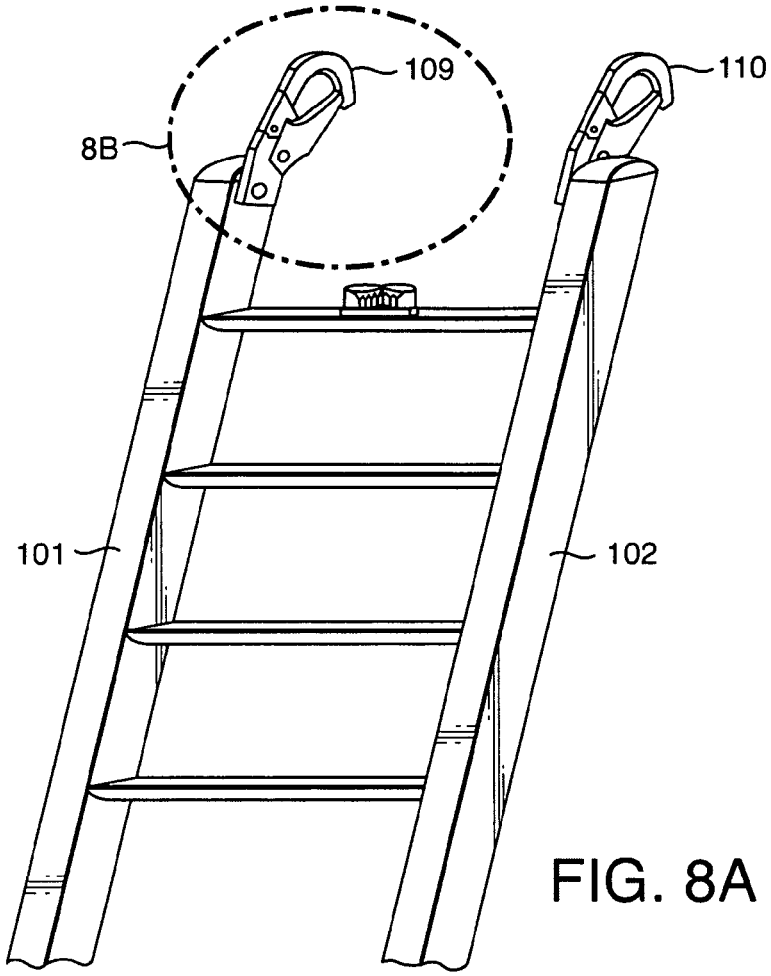
FIG. 8A shows the top of the ladder of FIG. 1 (excluding rope) with additional safety features.
Figure 8B:
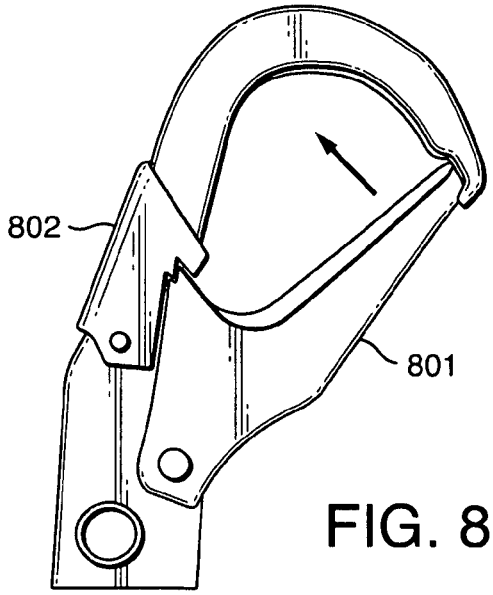
FIG. 8B shows an example of a spring-loaded hook of the kind that could be used in the embodiment shown in FIG. 8A.

FIG. 8A shows the top of the ladder of FIG. 1 without the rope. FIG. 8B shows an example of a spring-loaded hook of the kind that could be used in the embodiment shown in FIG. 8A. Hooks 109 and 110 can be spring loaded so that they open when forced against a horizontal cable and then snap shut around the cable. They can be manually released. They are particularly useful when there is a need for placing a ladder against a horizontal cable strung between two vertical poles. The ladder can be hooked onto the transverse cable, and removed from the transverse cable, for example, by someone in an elevated bucket on a bucket truck, thereby freeing the bucket truck for activity elsewhere, and temporarily leaving a ladder in place against the transverse cable. The hooks circumscribe the cable and, unless the cable itself breaks, the ladder shall remain supported by the cable regardless of cable motion due to wind, etc. FIG. 8B is an enlarged view of one of the hooks of FIG. 8A, showing a movable portion 801, and a latching mechanism 802. Any hook that can completely close around a cable can be used, and this is but one example of that genre of hook. In view of the possibility that these hooks could circumvent an insulated cable carrying electricity, for extra protection the hooks could be constructed from hard plastic or other non-conductive material if sufficiently strong to support the weight.

In operation, referring to all FIGS. 1-8, the operator or user or climber with ladder on the ground initially inserts rope 103 through rope cleat 104 and rope guide 105, as well as through rope-brake 600 and sets the ladder upright for climbing. If this is an extension ladder, the operator next extends ladder 100 to the proper height for the intended job and the rope moves in direction 119 shown in FIG. 3A. Thereafter, the operator snugs-up rope 103 by pulling excess rope-length through rope-brake 600 until taut and then activates rope clamp 603 to hold the rope taut. Thereafter, the operator dons body harness 700 and adjusts straps to fit. Thereafter, the operator attaches tabs 704 from the body harness to sleeve 107 by using a carabiner clip or similar strong metal clip 705, to fasten the nylon harness to the rope-constrained sleeve 107. Next, the operator checks the sleeve to be sure that camber-shaped pulley is in operative position with axel 509 in slot 512 to be able to cause a pinch point against rope 103 should operator fall in down direction 515 from ladder 100.

Then, the operator begins to climb up ladder 100 and pulley 501 rotates in a clockwise direction, while pulley 502 rotates in a counterclockwise direction and pulley 503 does not rotate at all. Although rope 103 makes firm contact with, and slides along, the circular section of pulley 503 while climbing, pulley 503 does not rotate in a counter clockwise manner because it is constrained against a hard physical stop. However, should the climber slip, friction forces caused by rope 103 against camber shaped pulley 503 cause it to rotate in a clockwise direction (particularly if the side wall at the periphery of the circular section of pulley 503 has properly oriented ridges or teeth) for less than a full rotation because the arch shaped portion of the pulley pinches the rope between pulley 501 and the arch of pulley 503, thereby preventing further relative movement between the rope and pulleys and saving the climber from falling in downward direction 515 more than a few inches, at most.

Figure 9:
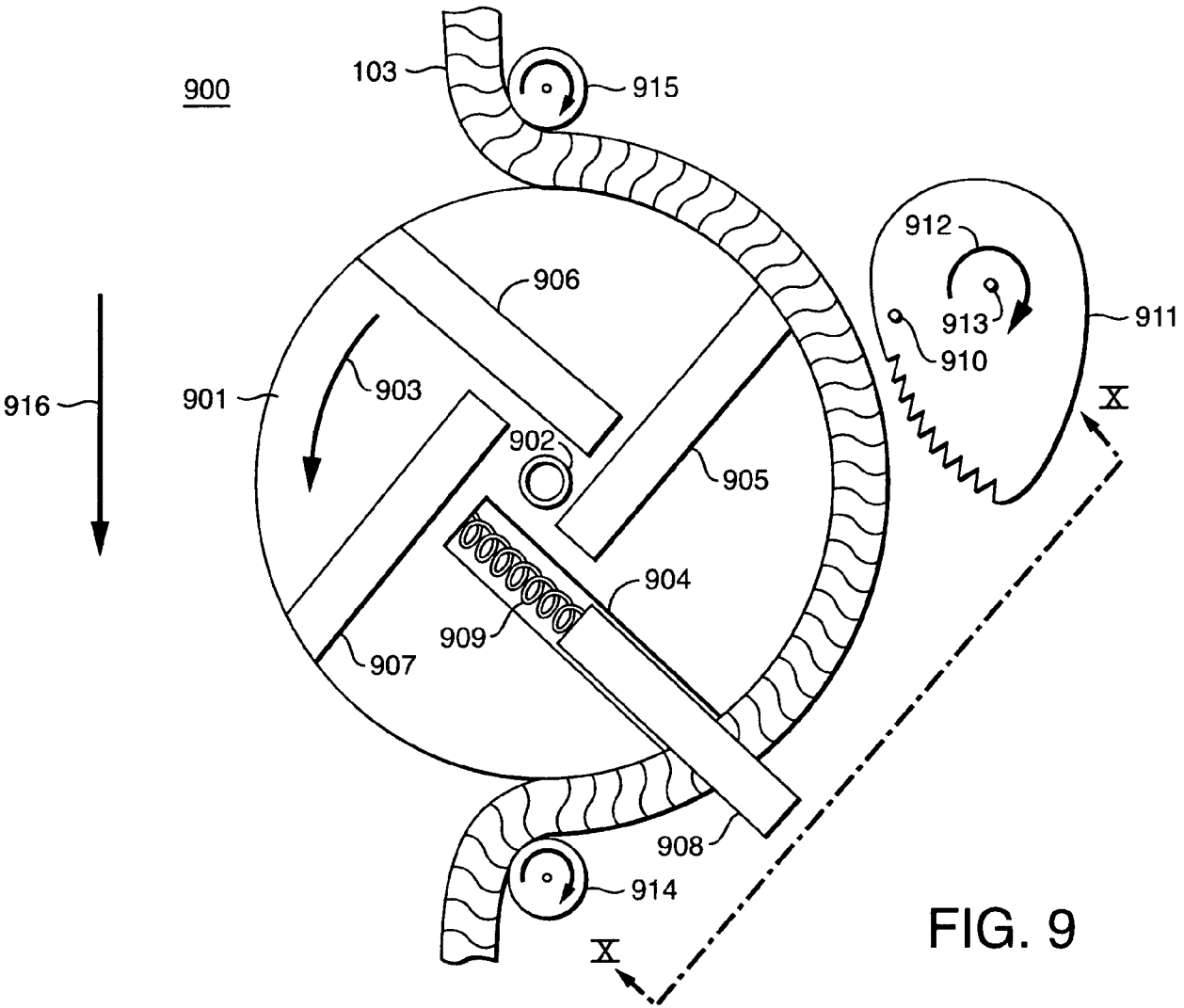
FIG. 9 is a schematic diagram of a plan view of an exemplary embodiment of a centrifugal brake which can replace and/or enhance certain functionality depicted in FIG. 5.

FIG. 9 is a schematic diagram of an exemplary embodiment of a centrifugal brake which can replace and/or enhance certain functionality depicted in FIG. 5. Large circular pulley 901 can rotate in either direction around spindle 902 in response to frictional forces from rope 103 on the periphery of pulley 901. Rope 103 is constrained around pulley 901 as shown, and is tightly coupled to a portion of the periphery of pulley 901 by smaller guide pulleys 914 and 915 which also can rotate in either direction. As a climber descends the ladder in direction 916, large pulley 901 rotates in counterclockwise direction 903 while guide pulleys 914 and 915 rotate in clockwise directions as shown by their respective clockwise arrows.

Figure 10:
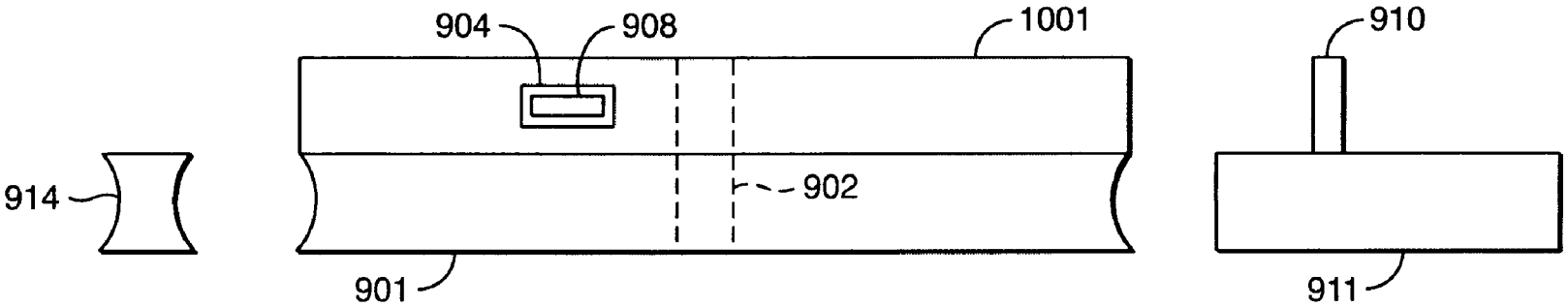
FIG. 10 is an elevation view of the centrifugal brake of FIG. 9 taken along the site line X-X, but with the rope not shown in this Fig.

Affixed to a surface of pulley 901 is a locking-bar housing (outer surface of the housing not shown in this Fig. but is shown in FIG. 10 described below). The housing contains four receptacles 904, 905, 906 and 907. Each receptacle is configured to receive one of four spring-mounted metal fingers or locking-bars. Only one such finger or locking bar 908 is shown in this Fig. to enhance clarity of presentation, but there is an equivalent spring-mounted finger in each receptacle. Spring 909 is operatively coupled between the internal end of locking bar 908 and the locking bar housing which is structure fixedly connected to, and rotating with, pulley 901. Spring 909 is normally in a compressed state wherefore locking bar 908 is normally pulled by the spring back into receptacle 904 so that it does not extend outwardly beyond the periphery of pulley 901.

The normally compressed state of spring 909 (and of the other un-shown three springs in receptacles 905-907) is achieved when pulley 901 is either not rotating or is rotating at a slow angular velocity such as that associated with a human being climbing ladder 100, either up or down. The normal climbing speed, up or down, on this ladder is insufficient to cause pulley 901 to rotate fast enough to create enough centrifugal force on locking bar 908 to overcome the compressed spring force of spring 909 and likewise for the other springs and locking bars (not shown) in receptacles 905-907. In other words, all locking bars stay tucked in their respective receptacles and do not protrude beyond the pulley's periphery when normal climbing or descending is occurring.

But, when a climber loses footing while on the ladder and starts to fall, whether from the top of the ladder or from elsewhere on the ladder, suddenly pulley 901 is caused to rotate very rapidly in direction 903 caused by frictional forces from rope 103 on the periphery of pulley 901. This generates sufficiently high centrifugal forces in pulley 901 to overcome the compressive spring force of spring 909. Consequently, locking bar 908 juts outward from its tucked-in position to that which is shown in FIG. 9, (as do the other three locking bars, not shown) as pulley 901 spins with protruding locking bar 908 heading towards trigger pin 910.

Camber-shaped pulley 911 is similar in configuration to one of the pair of cam cleats of FIG. 3A. Camber-shaped pulley 911 can rotate, within narrow constraints and less than a full revolution, about spindle or axis 913 in either direction, similar to rotational motion of camber-shaped pulley 503 of FIG. 5. Camber-shaped pulley 911 is normally spring biased (coil spring not shown) in a counterclockwise direction against a constraint stop (not shown). In other words, pulley 911 normally sits in the position shown in FIG. 9. Trigger pin 910 juts upward from the plane of the drawing and is sufficiently long to engage metal finger 908 as it rapidly rotates counterclockwise. The engagement, the striking of trigger pin 910 by metal finger 908, causes camber-shaped pulley to rotate in a clockwise direction about its axis of rotation, with its teeth prepared to bite into rope 103 as all structure shown (but for the rope) moves downward together in direction 916 responsive to a person falling from ladder 100. As soon as the teeth of pulley 911 bites rope 103, the downward drop of that person is arrested. The reason why four such spring-restrained fingers are used is to provide an engagement with tab or trigger pin 910 in possibly only a quarter turn of pulley 901, rather than possibly wait for almost a complete revolution of pulley 901 to arrest the fall, that delay being a function of position of the metal finger 908 at the precise time when the climber's footing is lost. The faster the engagement, the less the vertical drop of, and the less the force exerted on, the body of the person falling from the ladder.

Once the falling climber regains footing on the ladder, finger 908 shall retract back into its receptacle in response to force from spring 909. This removes the force on trigger tab 910 that was exerted by finger 908 and camber shaped pulley 911 returns to its unlocked or open state in response to a counter-clockwise coiled-spring (not shown) force on its spindle 910. The climber can then resume climbing up or down and a serious fall has been prevented.

FIG. 10 is an elevation or side view of the centrifugal brake of FIG. 9 taken along the site line X-X, but with the rope not shown in this Fig. Again, pulley 901 rotates about spindle 902 and guide pulley 914 is shown at left. Camber shaped pulley 911 is shown at right. Housing 1001 is shown affixed to and supported by structure such as spindle 902 and can be integrated with pulley 901 as a continuous, single component that rotates with the pulley. Housing 1001 contains the four metal fingers discussed above, the end of one being shown in this view. The end of metal finger 908 is shown as it might appear tucked-into, or protruding out from, receptacle 904. It is clear from the relative positions and heights of metal finger 908 and trigger tab 910 in this Fig. that metal finger 908 can engage trigger tab 910 if protruding sufficiently from its rest position in enclosure 904. It is important that there is sufficient clearance between the rope (not shown) and the protruding metal finger, so that the rope does not prevent the metal finger from striking tab 910.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow.

For example, receptacles 904-907 can be radially oriented on pulley 901 rather than offset from a radial position as shown in FIG. 9. A radial position would provide a greater counter-spring, centrifugal force component on the metal fingers retracted within those receptacles as compared with the counter-spring force component on fingers retracted within the shown non-radial positions, for equal angular velocities. However, for equal-sized pulleys, the trade-off is length of metal finger vs. counter-spring, centrifugal force component. In other words, for a given pulley, the largest counter-spring force component (radial) is associated with the shortest metal finger (also radial). For a given downward displacement along the rope, if increased angular velocity of the metal fingers is desired to achieve higher counter-spring force, gear amplification can be used, where a pulley directly connected to the rope rotates a large gear at a first angular velocity which, in turn, rotates a small gear connected to structure containing the metal fingers at a much greater angular velocity.

For another example, a nylon lanyard or similar connector of one or two feet in length can be added to the tabs of the body harness to offer more freedom of movement to the climber when on the ladder, thereby trading-off additional freedom of movement while on the ladder against an additional one or two foot distance dropped if the climber falls. Additionally, when using an extension ladder which uses pulleys and rope to raise the fly or moveable section of that ladder, one could make use of that particular rope to also serve as the safety rope, rather than add dedicated safety rope 103 to the ladder as shown in the instant embodiments. There are other variations and modifications that can be made. Therefore, the specification and drawings are to be regarded in an illustrative rather than restrictive sense.

What is claimed is:

1. Apparatus comprising:

a ladder;

a rope connected to and looped around said ladder by being looped over a top rung of said ladder and looped under a bottom rung of said ladder, said looped rope being held immobile relative to said ladder in a taut manner;

a sleeve through which said rope is threaded, said sleeve including an internal mechanism allowing movement of said sleeve alone said rope directed toward said top rung and preventing said movement of said sleeve along said rope directed away from said top rung; and a safety harness worn by a climber of said ladder, said harness directly connected to said sleeve and not directly connected to said internal-mechanism included in said sleeve.

2. The apparatus of claim 1 wherein said climber is prevented from falling more than a few inches from an elevated position.

3. Apparatus, comprising:

a ladder having a pair of side rails and a plurality of rungs fixedly connected to said side rails;

a single looped rope looped around said ladder, by being looped over and touching the top of a top rung of said ladder, and looped under and touching the bottom of a bottom rung of said ladder, said looped rope being held immobile relative to said ladder in a taut manner;

a sleeve through which said rope is threaded, said sleeve including a mechanism allowing movement of said sleeve along said rope directed toward said top rung and preventing said movement of said sleeve along said rope directed away from said top rung; and a safety harness worn by a climber of said ladder, said harness directly connected to said sleeve and not directly connected to said mechanism included in said sleeve;

whereby said climber is not prevented by said sleeve from climbing said ladder in the direction of said top rung while a fall from said ladder by said climber is arrested by cooperation of said harness, said sleeve, said direct connection, said rope and said ladder.

4. The apparatus of claim 3 wherein said sleeve further comprises:

an over-ride control operable by said climber for over-riding said mechanism to the extent of over-riding said preventing said movement of said sleeve along said rope directed away from said top rung, whereby said sleeve freely moves in the direction away from said top rung under climber control.

5. The apparatus of claim 3 or claim 1 wherein said sleeve includes all of said mechanism internal to said sleeve.

6. The apparatus of claim 3, further comprising:

a pair of rope guides, one attached to the top of the top rune of said ladder and the other attached to the bottom of the bottom rung of said ladder to hold said rope generally parallel to said side rails of said ladder.

7. The apparatus of claim 6 wherein said rope guides hold said rope at respective midpoints of said rungs.

8. The apparatus of claim 6, further comprising:

a rope brake device fixedly attached to one end of said rope; said rope being held between a pair of rope guides in a manner to create said single looped rope encompassing all rungs of said ladder and thereafter being inserted through said rope brake device to an extent necessary to enable said rope brake device to firmly hold said rope at a fixed position on said rope ensuring that said single loop is taut.

9. The apparatus of claim 8 wherein said rope brake device is positioned on said rope on a rear side of said ladder opposite from a front side of said ladder upon which said climber climbs.

10. The apparatus of claim 8 wherein said sleeve is positioned on said rope on a front side of said ladder upon which said climber climbs.

11. The apparatus of claim 8 wherein said ladder is an extension ladder.

12. The apparatus of claim 11 for use with an elevated cable strung between vertical poles, said extension ladder further comprising:

a pair of spring-loaded hooks, one of said hooks affixed to the top of one of said side rails of said extension ladder and the other one of said hooks affixed to the top of the other one of said side rails of said ladder;

whereby said hooks on said extension ladder may be caused to engage said elevated cable in a manner to prevent said ladder from falling from said cable.

* * * * *